US006337544B1

(12) United States Patent
Wang et al.

(10) Patent No.: US 6,337,544 B1
(45) Date of Patent: Jan. 8, 2002

(54) DIGITAL LAMP SIGNAL PROCESSOR

(75) Inventors: Shenghong Wang, Yorktown Heights, NY (US); Demetri J. Giannopoulos, Norwalk, CT (US); Ihor T. Wacyk, Briarcliff Manor, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/460,937

(22) Filed: Dec. 14, 1999

(51) Int. Cl.[7] ..... G05F 1/00
(52) U.S. Cl. ..... 315/291; 315/307; 315/DIG. 4
(58) Field of Search ..... 315/291, 297, 315/307, DIG. 4, 194, 224, 225, 219, 293, 292

(56) References Cited

U.S. PATENT DOCUMENTS

| | | | | |
|---|---|---|---|---|
| 4,396,872 A | | 8/1983 | Nutter | 315/308 |
| 5,039,921 A | | 8/1991 | Kakitani | 315/307 |
| 5,770,926 A | * | 6/1998 | Choi et al. | 315/307 |
| 5,864,110 A | * | 1/1999 | Moriguchi et al. | 219/121.57 |
| 5,956,265 A | * | 9/1999 | Lewis | 364/757 |
| 5,969,482 A | * | 10/1999 | Gradziki | 315/224 |
| 5,973,458 A | * | 10/1999 | Seo et al. | 315/308 |
| 6,046,551 A | * | 4/2000 | Kita | 315/307 |
| 6,057,651 A | * | 5/2000 | Usami | 315/291 |
| 6,160,361 A | * | 12/2000 | Giannopoulos et al. | 315/307 |

FOREIGN PATENT DOCUMENTS

| | | |
|---|---|---|
| JP | 63073766 | 4/1988 |
| JP | 11144887 | 5/1999 |

OTHER PUBLICATIONS

"Beleuchtung wird busfahig", by Siegfried Luger et al, Elektronic 26/1992, pp. 26–30.
"An Integrated Digital control for Electronic Lighting", by Robert E. Corbett, IEEE 1997, pp. 345–350.

* cited by examiner

*Primary Examiner*—Don Wong
*Assistant Examiner*—Tuyet T. Vo
(74) *Attorney, Agent, or Firm*—Bernard Franzblau; Edward Blocker

(57) ABSTRACT

A digital lamp signal processor senses lamp current and lamp voltage in real time. These two signals are sufficient to obtain information, such as real lamp power calculation, necessary to control ballast operation and fault detection. The apparatus measures the phase of lamp current and voltage, the peak current and voltage, and calculates the average lamp current and voltage. The digital lamp signal processor eliminates the effect of parasitic capacitance of power wiring and a signal condition circuit. It may detect and control hard switching and apply over current and voltage protection. The apparatus directly processes AC signals, allowing for simple and easily integrated single chip design.

31 Claims, 2 Drawing Sheets

DIGITAL LAMP SIGNAL PROCESSOR

BACKGROUND OF THE INVENTION

1. Field of the Invention

The present invention relates to fluorescent lamp ballasts and more specifically to a digital control circuit that can achieve a real lamp power calculation in real time.

2. Description of the Background of the Invention

Analog ballast may achieve low cost and low power consumption. However, the performance of an analog ballast is limited due to effects of parasitic components and noise sensitivity on accuracy. Furthermore, the functionality, flexibility, and programmability of the analog ballast are also limited, since analog ballasts use multiple resistors and capacitors, which are difficult to implement using standard integrated circuit (IC) processing technology. Additionally, analog ballasts are complex and bulky.

Most dimmable high frequency (HF) electronic ballasts use analog ICs to control various operations of fluorescent lamps. These control operations may include preheat, ignition, burn standby, power regulation, and dimming. Some electronic ballasts may use standard CPUs or micro-controllers to control the operation of fluorescent lamps. For those ballasts the functionality, flexibility, and programmability is much improved.

However, due to the speed limitation, a standard CPU cannot process alternating current (AC) lamp signals in real time in order to obtain the required information, such as the phase of a current or voltage, peak current or voltage, real power, etc. This information is very important for a dimmable ballast control. Therefore, these kinds of digital ballasts have to sample more signals and require complicated signal condition circuits that are very difficult to integrate.

Furthermore, standard off-the-shelf micro-controllers with on-chip Analog-to-Digital (A/D) converters use slow on-chip A/D converters and are too slow to process the output of a high-speed A/D converter. Having slow on-chip A/D converters, the analog input signals are filtered externally, requiring additional external components. Additionally, filtering removes useful information from the input analog signal thereby limiting what can be regulated, e.g., real lamp power may not be regulated.

What is needed is a lamp signal processor able to use fast A/D converters, which may achieve the real lamp power calculation in real-time.

SUMMARY OF THE INVENTION

To achieve the real-time lamp signal processing, the present invention introduces a specific digital ballast control IC, designed and used in conjunction with analog digital ballasts.

The inventive digital lamp signal processor senses lamp current and lamp voltage in real time. These two signals are sufficient to obtain information, such as real lamp power calculation, necessary to control ballast operation and fault detection. The invention measures the phase of lamp current and voltage, the peak current and voltage, and calculates the average lamp current and voltage.

The inventive digital lamp signal processor eliminates the effect of parasitic capacitance of power wiring and a signal condition circuit. It may detect and control hard switching, and apply the over current and voltage protection. The invention directly processes AC signals allowing for simple and easily integrated single chip design.

BRIEF DESCRIPTION OF THE DRAWINGS

The foregoing objects and advantages of the present invention may be more readily understood by one skilled in the art with reference to the following detailed description of a preferred embodiment thereof, taken in conjunction with the accompanying drawings wherein like elements are designated by identical reference numerals throughout the several views, and in which.

DETAILED DESCRIPTION OF THE INVENTION

The inventive digital ballast circuit 1 uses the digital lamp signal processing (DLSP) technology to process an AC lamp current 2 and lamp voltage 3 in real time. Although currents other than lamp current, e.g., inductor current, or a combination of currents simultaneously, e.g., lamp and inductor currents, may be processed by the DLSP, for simplicity the term lamp current will be used to describe all situations. The ballast circuit 1 needs only to sense lamp current $i_l$ 2 and lamp voltage $v_l$ 3 signals to obtain the information required for the ballast operation control and fault detection.

The inventive DLSP when used in conjunction with the sampling of $i_l$ 2 and $v_l$ 3, may achieve the control of the peak lamp current and voltage, the real lamp power and of the rectified average lamp current and voltage. The DLSP may also detect the ignition fault, the capacitor mode and lamp presence, as well as the proportion of negative and positive lamp current for end of lamp life.

Furthermore, since the ballast may process AC signals directly, the signal condition circuits are very simple and easy to integrate into a single chip. Therefore, the cost, size, and component count of the inventive ballast are reduced significantly.

Figure 1:
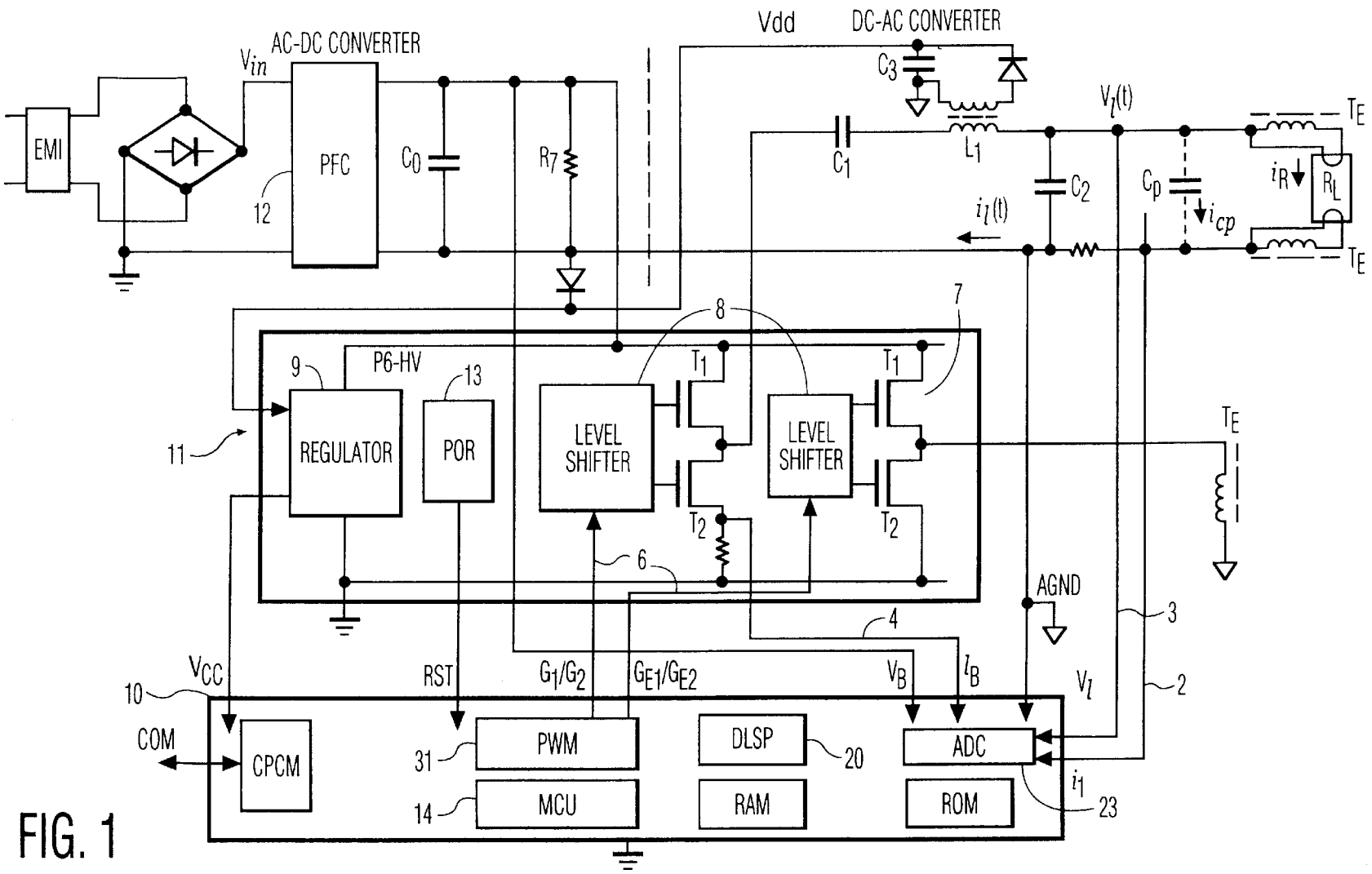
FIG. 1 is a system architecture diagram of the electronic ballast using an inventive digital lamp signal processor.

FIG. 1 shows the inventive low-voltage digital lamp signal processor circuit 20 utilized in a ballast circuit 1 comprising a fast A/D converter 23 to over-sample, e.g., 32× over-sampling. Analog input signals, e.g., lamp voltage 3, lamp current 2, half-bridge power switch current 4, may be received from a power stage 5. Digital output signals of the A/D converter 23 are sent to the DLSP circuit 20, which on a per-cycle basis calculates the power by multiplying and averaging the digital signals corresponding to the two input analog signals 2, 3; and an average value of each input signal. The DLSP circuit 20 further rectifies the input signals received from the A/D converter 23 followed by calculating average values of the rectified input signals and their peak values, and by detecting phases of the two input signals.

The Pulse Width Modulation (PWM) circuit 31 generates output signals 6. The frequency and duty-cycle of the PWM signals depend on the outcome of operations performed in the DLSP circuit 20. By varying the frequency/duty-cycle of the PWM signals, the lamp power or lamp current may be regulated at a selected level.

The PWM circuit 31 generated signals $G_1$, $G_2$, $G_{E1}$, $G_{E2}$ 6 are created by a low-voltage integrated circuit with a voltage of 3.3V or less and are referenced to a ground level. The level shifters 8 may be used to perform the function of level-shifting of signals 6 before they may be applied to the gates of the power switches $T_1$, $T_2$, $T_{E1}$, $T_{E2}$ 7 in order to control the ON/OFF state of these switches.

The regulator 9 generates the supply voltages for the low voltage, i.e., 3.3V or less, integrated circuit 10 and the supply voltage of the high voltage, i.e., 12V or higher, integrated circuit 11 from the pre-conditioner power factor correction (PFC) circuit 12 output voltage. The power-on reset (POR) circuit 13 generates a reset pulse, which may be applied to a reset pin of the low voltage integrated circuit 10 when both integrated circuits 10, 11 are powered on.

The micro-controller unit (MCU) 14 may be used to set the following functions and parameters:

1. the sequence of the ballast operation, e.g., electrode heating, ignition, lamp output regulation;
2. the mode of operation, e.g., symmetric PWM or asymmetric PWM, frequency shift or PWM control;
3. electrode pre-heat period;
4. slow signal processing, e.g., filtering for compensation of feedback loop; and
5. slow protection, e.g., detection of end-of-life for lamp.

Figure 2:
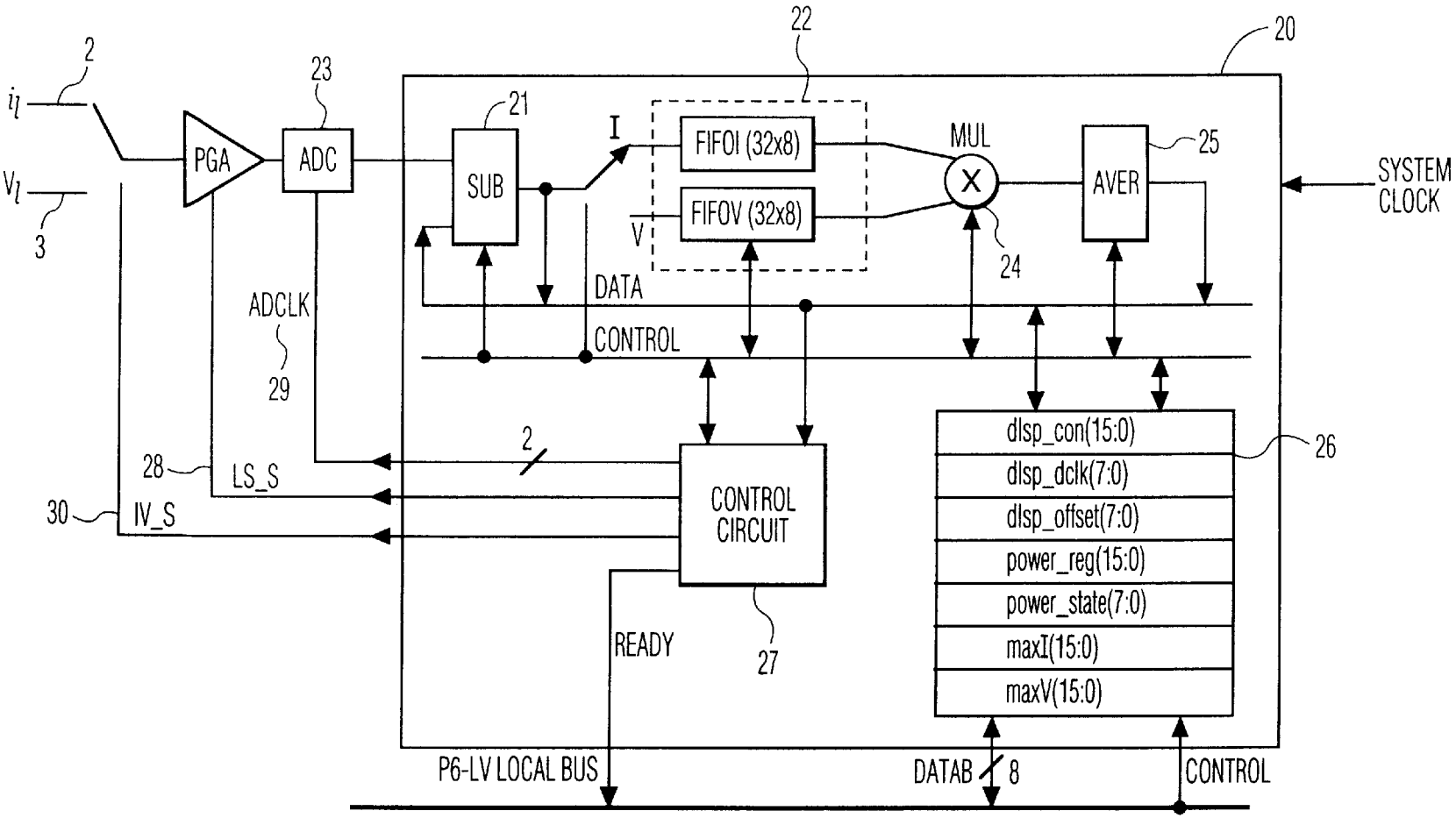
FIG. 2 is an architectural diagram of the inventive digital lamp signal processor.

FIG. 2 shows the inventive DLSP circuit 20 comprising a digital subtract circuit 21 used to receive data sampling current 2 and voltage 3 signals from a high-speed A/D converter (ADC) circuit 23 and to remove the offset created by the analog data sampling. Changing of the offset value allows the DLSP circuit 20 to process signed and unsigned data. The digital subtract 21 may also be used to extract a peak value of lamp current 2 and voltage 3 which are used for over-voltage protection, large and small current and voltage operation model switching control, etc.

First In First Out (FIFO) 32 by 8 bit buffers 22 may be used to store sampled current and voltage data. The use of FIFO buffers 22 eliminates the need for more than one ADC circuit 23, which is the most: expensive and complicated part of the circuit to be implemented in the inventive ballast circuit. The FIFO buffers 22 may be implemented using DRAM, SRAM, or flip-flop transistors. A digital multiplier circuit 24 may be connected to the FIFO buffers 22 and is used to multiply the lamp current and voltage values stored there, in order to obtain the dynamic lamp power used for ballast control.

A digital average circuit 25 is provided for calculating the average lamp power and for sending the results to the power registers 26. The DLSP may also be controlled to calculate the average current and voltage information that is very important for digital ballast operation. A control logic circuit 27 is used to generate the control signals, such as large/small signal switching (LS_S) 28, ADC clock (ADCLK) 29, and current/voltage switching (IV_S) 30.

While the invention has been particularly shown and described with respect to illustrative and preferred embodiments thereof, it will be understood by those skilled in the art that the foregoing and other changes in form and details may be made therein without departing from the spirit and scope of the invention, which is limited only by the scope of the appended claims.

Having thus described our invention, what we claim as new, and desire to secure by Letters Patent is:

1. A discharge lamp lighting apparatus comprising:

an input terminal for connection to a source of DC supply voltage for the lighting apparatus, a DC/AC converter including at least one power switching device and having an input coupled to said input terminal and an output coupled to an output circuit for connection to a discharge lamp, means for deriving analog lamp current signals and lamp voltage signals, an analog/digital (A/D) converter for over-sampling said analog lamp current signals and lamp voltage signals so as to derive corresponding digital lamp current signals and lamp voltage signals, a digital lamp signal processor responsive to said digital lamp current signals and lamp voltage signals to derive a digital lamp power signal on a per-cycle basis, and a pulse width modulation circuit responsive to said digital lamp power signal to control the switching operation of said switching device.

2. The lamp lighting apparatus as claimed in claim 1 wherein the digital lamp signal processor is a low voltage digital lamp signal processor, said apparatus further comprising;

at least one voltage level shifter circuit coupled between an output of the pulse width modulation circuit and a control electrode of the switching device so as to control said switching operation of the switching device.

3. The lamp lighting apparatus as claimed in claim 1 wherein the DC supply voltage source includes an AC/DC converter, the lamp lighting apparatus further comprising a voltage regulator having an input coupled to an output of the AC/DC converter and a high voltage output that provides a DC supply voltage for the at least one power switching device and a low voltage output that provides a DC supply voltage for the PWM circuit.

4. The lamp lighting apparatus as claimed in claim 1 wherein the digital lamp signal processor comprises;

means for calculating, on a per-cycle basis, the lamp power by multiplying and averaging the input digital lamp current and voltage signals, means for rectifying the digital input signals from the analog/digital converter, and means for calculating average values of the rectified input signals received from the analog/digital converter and their peak values.

5. The lamp lighting apparatus as claimed in claim 1 wherein the digital lamp signal processor comprises;

a digital multiplier circuit which multiplies lamp current and lamp voltage, and a digital average circuit coupled to an output of the digital multiplier circuit thereby to derive the average lamp power.

6. The lamp lighting apparatus as claimed in claim 1 wherein said digital lamp signal processor comprises;

a digital subtraction circuit which receives said digital lamp current signals and digital lamp voltage signals, digital storage means coupled to an output of the digital subtraction circuit, and a digital multiplier circuit coupled to the digital storage means for deriving the digital lamp power signal.

7. The lamp lighting apparatus as claimed in claim 6 wherein said digital subtraction circuit extracts peak values of the lamp current signal and the lamp voltage signal.

8. The lamp lighting apparatus as claimed in claim 6 further comprising a digital control circuit coupled to the digital subtraction circuit, and wherein the digital subtraction circuit removes an offset present in the digital lamp current and digital lamp voltage signals as a result of analog sampling of the analog lamp current signals and analog lamp voltage signals.

9. The lamp lighting apparatus as claimed in claim 8 wherein the digital lamp signal processor further comprises;

an averaging circuit coupled to an output of the digital multiplier circuit for deriving an average lamp power signal, and storage register means coupled to said averaging circuit for storing said derived average lamp power signal.

10. A method of energizing a discharge lamp, which method comprises;

deriving analog lamp current and lamp voltage signals, over-sampling said analog lamp current and lamp voltage signals and deriving corresponding digital lamp current and lamp voltage signals, applying said digital lamp current and lamp voltage signals to a subtraction circuit for removing an offset created by oversampling said analog lamp current and lamp voltage signals, multiplying digital signals from an output of the subtraction circuit to produce a dynamic lamp power signal, and controlling the energization of the discharge lamp by means of the lamp power signal.

11. The lamp energizing method as claimed in claim 10 which further comprises;

extracting, by means of the subtraction circuit, peak values of the lamp current signals and the lamp voltage signals thereby to provide over-voltage protection.

12. The lamp energizing method as claimed in claim 10 which further comprises;

controlling peak lamp current and voltage, real lamp power and a rectified average lamp current and voltage.

13. The lamp energizing method as claimed in claim 10 which further comprises;

detecting an ignition fault, a capacitor mode and lamp presence and absence.

14. The lamp energizing method as claimed in claim 10 wherein the lamp energization controlling step comprises varying frequency/duty cycle of output control signals in a manner so as to regulate lamp power and lamp current at a selected level.

15. A digital lamp signal processor for operation, control and fault detection of a ballast, said processor comprising:

a digital subtract circuit for receiving sampling current signals and sampling voltage signals;

at least one buffer for storing said sampling current signals and said sampling voltage signals;

a digital multiplier circuit connected to said at least one buffer for multiplying said sampling current signals and said sampling voltage signals to obtain a dynamic lamp power signal;

a plurality of registers for storing signals and values;

an average circuit for calculating an average lamp power and for storing said calculated average lamp power in said registers; and a control logic circuit for generating control signals.

16. The processor of claim 15, further comprising a high-speed A/D converter circuit for providing said sampling current signals and said sampling voltage signals.

17. The processor of claim 16, wherein said digital subtract circuit removes an offset created by analog data sampling for enabling said processor to process signed and unsigned data.

18. The processor of claim 17, wherein said digital subtract circuit is used to extract peak values of said current signal and said voltage signal.

19. The processor of claim 18, wherein said peak values are used for over-voltage protection, large and small current and voltage operation model switching control.

20. The processor of claim 19, wherein said buffer is of a FIFO type and is from 4 to 32 bits in length and 8 bits in height.

21. The processor of claim 20, wherein buffers eliminate the need for more than one A/D converter circuit.

22. The processor of claim 21, wherein said at least one buffer comprises DRAM, SRAM, or flip-flop transistors.

23. The processor of claim 15, wherein said dynamic lamp power signal is used for ballast control.

24. The processor of claim 23, wherein said control logic circuit further generates a large to small switching signal and a current and voltage switching signal.

25. The processor of claim 24, wherein the processor achieves control of peak lamp current and voltage, the real lamp power and of the rectified average lamp current and voltage.

26. The processor of claim 25, wherein the processor detects an ignition fault, a capacitor mode, lamp presence and absence, a proportion of negative and positive lamp current for end of lamp life.

27. A ballast circuit employing a low-voltage digital lamp signal processor, said ballast circuit comprising:

an A/D converter for over-sampling analog input lamp current signals and lamp voltage signals and communicating digital output signals to said digital lamp signal processor;

at least one level shifter for shifting of Pulse Width Modulation output signals generated by said signal processor before said Pulse Width Modulation output signals are applied to power switch gates in order to control an ON/OFF state of said power switch gates;

a regulator circuit for generating a supply voltage for a low voltage integrated circuit and a supply voltage of a high voltage integrated circuit from a power factor correction circuit output voltage;

a power-on reset circuit for generating a reset pulse; and a micro-controller unit.

28. The ballast circuit of claim 27, wherein said signal processor calculates lamp power on a per-cycle basis by multiplying and averaging said analog input lamp current signals and lamp voltage signals and an average value of each input signal.

29. The ballast circuit of claim 28, wherein said signal processor rectifies said digital output signals by calculating average values of said digital output signals and their peak values and by detecting phases of said digital output signals.

30. The ballast circuit of claim 27, wherein lamp power and lamp current is regulated at a selected level by varying a frequency/duty-cycle of said Pulse Width Modulation output signals.

31. The ballast circuit of claim 30, wherein AC signals are processed directly, simplifying signal condition circuits for integration into a single chip, thereby significantly reducing cost, size and component count of said ballast circuit.

* * * * *